US007718244B1

(12) United States Patent
Zepeda

(10) Patent No.: US 7,718,244 B1
(45) Date of Patent: May 18, 2010

(54) PROTECTIVE MAT ASSEMBLY FOR A BOXING RING

(76) Inventor: Fred Zepeda, 5167 Perkins Rd., Oxnard, CA (US) 93033

( * ) Notice: Subject to any disclaimer, the term of this patent is extended or adjusted under 35 U.S.C. 154(b) by 82 days.

(21) Appl. No.: 12/022,604

(22) Filed: Jan. 30, 2008

Related U.S. Application Data

(60) Provisional application No. 60/918,336, filed on Mar. 16, 2007.

(51) Int. Cl.
*B32B 3/06* (2006.01)
*B32B 3/10* (2006.01)

(52) U.S. Cl. ..... 428/100; 428/119; 428/138

(58) Field of Classification Search ..... 428/99, 428/100, 119, 138, 192
See application file for complete search history.

(56) References Cited

U.S. PATENT DOCUMENTS

2005/0088020 A1* 4/2005 Munoz ..... 297/217.1

FOREIGN PATENT DOCUMENTS

GB 2268399 A * 1/1994

* cited by examiner

*Primary Examiner*—Alexander Thomas
(74) *Attorney, Agent, or Firm*—Kenneth L Tolar

(57) ABSTRACT

A protective mat assembly for a boxing ring includes a substantially trapezoidal base mat having multiple strips of hook and loop fasteners on the upper surface thereof. A similarly-shaped absorbent foam pad includes a plurality of mating hook and loop fastener strips on a lower surface to engage those of the base mat. The absorbent pad includes foot indentions for receiving a boxer's feet, and openings for receiving the legs of a boxer's stool. Accordingly, when a fighter sits on the stool between rounds, the underlying absorbent pad collects any fluids that would otherwise fall onto the ring surface.

6 Claims, 1 Drawing Sheet

PROTECTIVE MAT ASSEMBLY FOR A BOXING RING

CROSS REFERENCE TO RELATED APPLICATIONS

This application is entitled to the benefit of provisional application No. 60/918, 336 filed on Mar. 16, 2007, the specification of which is incorporated herein by reference.

BACKGROUND OF THE INVENTION

The present invention relates to a mat assembly for collecting fluids emanating from a fighter.

DESCRIPTION OF THE PRIOR ART

Boxers, wrestlers and ultimate fighters usually compete in a designated area referred to as a ring. Between rounds, each fighter returns to a respective corner of the ring to remove accumulated bodily fluids, to rinse and to rehydrate. Because the fighter is seated for several minutes, blood, rinse water, perspiration and other fluids often fall onto the ring thereby exposing the fighters to severe health and safety risks. Accordingly, there is currently a need for a device that prevents such fluids from contacting a boxing ring surface. The present invention addresses this need by providing a uniquely designed mat assembly that is temporarily placed into a corner of a ring to collect and absorb fluids emanating from a fighter.

SUMMARY OF THE INVENTION

A protective pad for a boxing ring includes a substantially trapezoidal panel having multiple strips of hook and loop fasteners on the upper surface thereof. A similarly-shaped absorbent foam pad includes a plurality of mating hook and loop fastener strips on a lower surface to engage those of the base mat. The absorbent pad includes foot indentions for receiving a boxer's feet and openings for receiving the legs of a boxer's stool. Accordingly, when a boxer or other fighter sits on the stool between rounds, the underlying absorbent pad collects any fluids that would otherwise fall onto the ring surface.

It is therefore an object of the present invention to provide a mat assembly that enhances the safety associated with certain fighting matches.

It is another object of the present invention to provide a mat assembly that readily absorbs fluids emanating from a fighter.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
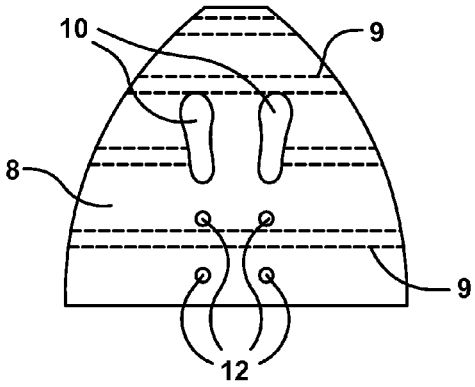
FIG. 1 is a top, plan view of the mat assembly according to the present invention.
Figure 2:
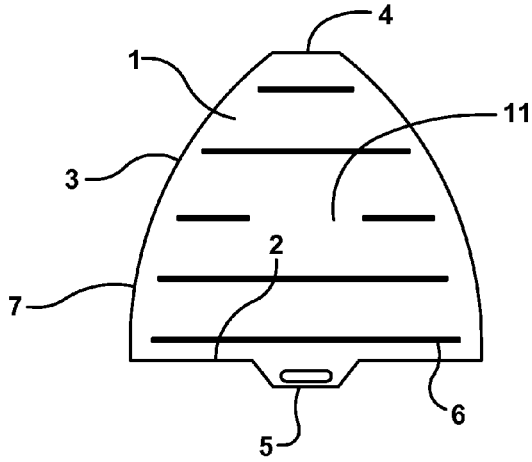
FIG. 2 is a top view of the base mat.
Figure 3:
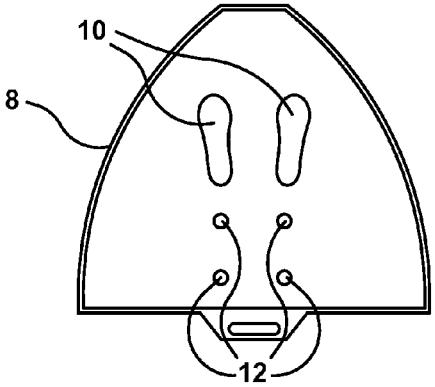
FIG. 3 is a top view of the absorbent foam pad.

The present invention relates to a protective mat assembly for a boxing ring. The device comprises a substantially trapezoidal base mat 1 having a wide-profile rear edge 2, tapering side edges 3 and a narrow-profile front edge 4. Integrally extending from the wide-profile rear edge is a handle 5. Multiple strips of hook and loop fasteners 6 are positioned on the upper surface of the base mat. A continuous lip 7 borders the entire periphery of the base mat to retain fluids thereon.

The device also includes an absorbent pad 8 having a substantially identical dimension and configuration as the base mat so as to fit neatly within the area defined by the peripheral lip. On the lower surface of the pad are multiple strips 9 of hook and loop fasteners which are positioned and dimensioned to engage the mating fasteners on the base mat. The absorbent pad is constructed with foam or a similar material that readily absorbs perspiration, water, blood or other fluids. Formed on the upper surface of the absorbent pad are a pair of foot indentions 10 for receiving a fighter's feet. The portion 11 of the base mat immediately beneath the foot indentions is free of hook and loop fasteners so that the fighter's feet rest directly on the base mat. Immediately adjacent the foot indentions are four openings 12 for receiving the legs of a boxer's stool or chair.

Accordingly, between rounds, the pad is positioned within the corner of a boxing ring. A stool is placed on the pad with its legs received within the leg openings allowing a boxer to sit and comfortably place his feet within the foot indentions. While the boxer is rehydrating and receiving other care, any errant fluid emanating from the boxer is readily absorbed by the underlying absorbent pad.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A protective mat assembly for a boxing ring comprising:

a base mat having an upper surface and at least one peripheral edge;

a first fastener on the upper surface of said base mat;

an absorbent pad having a lower surface, said pad having a substantially identical dimension and configuration as the base mat;

a second fastener on the lower surface of said pad for mating engagement with said first fastener allowing said pad to be removably superimposed onto said base mat whereby fluids emanating from a boxer resting on said pad will be absorbed;

a pair of foot-shaped apertures in said pad and in communication with the base mat for receiving a fighter's feet.

2. The protective mat assembly according to claim 1 further comprising a plurality of openings immediately adjacent the foot-shaped apertures for receiving legs on a boxer's stool.

3. The protective mat assembly according to claim 2 wherein the first fastener and the second fastener each include multiple strips of hook and loop fasteners.

4. The protective mat assembly according to claim 3 wherein said first fastener circumvents a portion of the base mat immediately beneath the foot-shaped apertures so that a fighter's feet rest directly on the base mat.

5. The protective mat assembly according to claim 4 further comprising a continuous lip bordering the peripheral edge of the base mat to retain fluids thereon.

6. The protective mat assembly according to claim 5 further comprising a handle integrally extending from the peripheral edge of said base mat.

* * * * *